United States Patent [19]

Beck

[11] Patent Number: 5,037,149

[45] Date of Patent: Aug. 6, 1991

[54] DOG LITTER CLEANUP BAG

[76] Inventor: Warren R. Beck, 1567 Atlantic St., St. Paul, Minn. 55106

[21] Appl. No.: 505,402

[22] Filed: Apr. 6, 1990

Related U.S. Application Data

[63] Continuation of Ser. No. 331,858, Apr. 3, 1989, abandoned.

[51] Int. Cl.[5] ..... A01K 29/00

[52] U.S. Cl. ..... 294/1.3; 15/257.1

[58] Field of Search ..... 294/1.3–1.5, 294/55; 383/33, 34; 15/257.1, 257.6, 257.9; 141/390, 316; 248/99, 100

[56] References Cited

U.S. PATENT DOCUMENTS

| | | | |
|---|---|---|---|
| 3,426,958 | 2/1969 | Gore | 248/99 X |
| 3,589,595 | 6/1971 | White | 383/33 X |
| 4,023,842 | 5/1977 | Harvey | 294/1.3 X |
| 4,103,952 | 8/1978 | Thompson | 294/1.3 |
| 4,138,153 | 2/1979 | Brown | 294/1.3 X |
| 4,159,139 | 6/1979 | Gawedzinski | 15/257.1 X |
| 4,466,647 | 8/1984 | Spevak | 294/1.5 |
| 4,664,348 | 5/1987 | Corsaut, III et al. | 248/99 |
| 4,760,982 | 8/1988 | Cooke | 141/390 X |

FOREIGN PATENT DOCUMENTS

| | | | |
|---|---|---|---|
| 1150742 | 4/1969 | United Kingdom | 383/34 |

*Primary Examiner*—Margaret A. Focarino
*Assistant Examiner*—Dean J. Kramer

[57] ABSTRACT

A bag for waste such as dog litter, having two stiffener ribs at or near its opening. Each stiffener is about one third the length of the opening circumference. The two stiffeners are flexibly joined at one end and their total length is about 60% to 80% of the circumference. A triangular bag opening is formed by spreading the distal ends of the stiffeners apart until the unstiffened portion of the bag opening becomes taut. In this position the bag is placed on the ground, held with a finger, and the litter pushed into it.

9 Claims, 1 Drawing Sheet

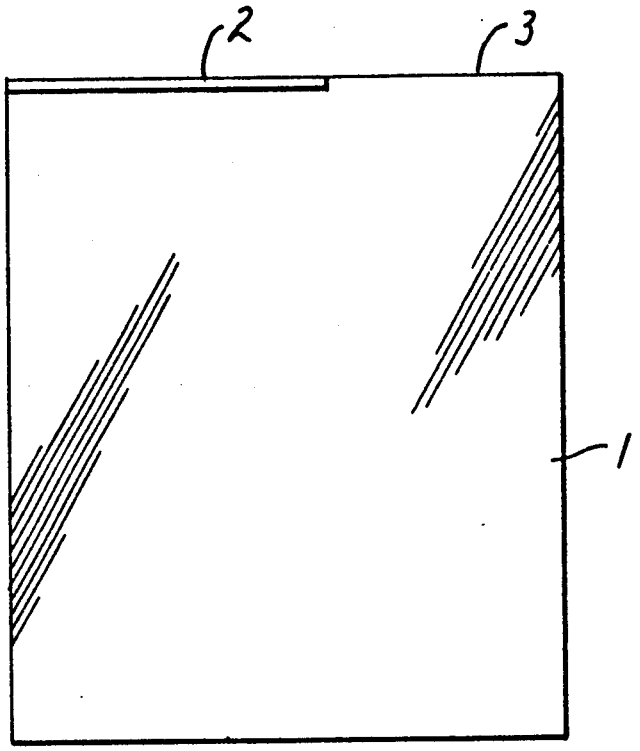
FIG. A
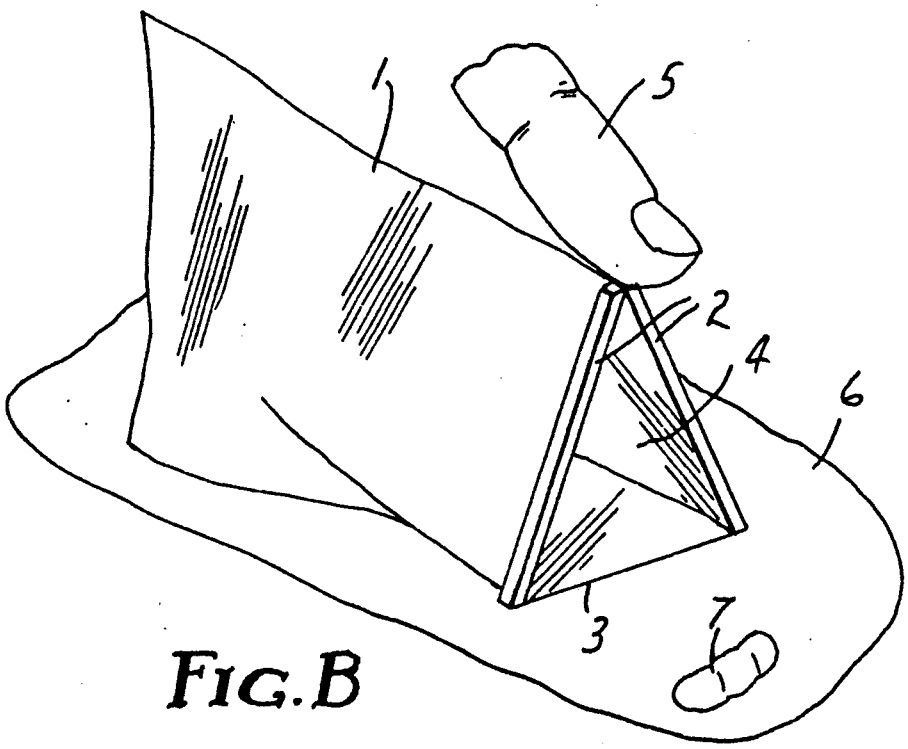
FIG. B

DOG LITTER CLEANUP BAG

This is a continuation of application Ser. No. 07/331,858, filed Apr. 3, 1989, now abandoned.

FIELD OF THE INVENTION

This invention relates to a modification of bags to make them useful for cleanup of dog litter without the use of enabling devices.

BACKGROUND ART

In many cities and parks the law and the need for cleanliness now requires that a person must clean up their own dog's litter. This need has resulted in a proliferation of devices and techniques for this purpose. Most of these devices are in the form of scoops or shovels, or are devices to facilitate the use of bags for the pickup of litter. Almost all of the patents of devices, as well as the devices seen in pet stores, have several drawbacks. These drawbacks are usually (a) awkwardness, (b) lack of cleanliness, and (c) unattractiveness.

There are many patents, most of them of recent origin, which are directed toward the cleanup of dog litter. The classifications which appear most pertinent are 294/1.3, 1.4, and 1.5, and 383/33 and 34. None of the art I found in these classifications appears to be prior art to my invention. However, one of the references, U.S. Pat. No. 4,768,818, issued Sept. 6, 1988, to Edwin S. Kolic, and titled "Disposable Litter Pickup Mitt," is related. It is essentially a bag with an inverted pocket allowing the user to insert his hand into the outer bag and pick up the litter in the inner bag. It appears to be the only prior art that avoids the drawbacks mentioned above.

There are many prior art patents on devices facilitating the use of bags for pet litter pickup. Some pertinent ones are disclosed in my pending U.S. application, Ser. No 250,533, filed Sept. 29, 1988 now U.S. Pat. No. 4,900,077.

DISCLOSURE OF INVENTION

From my patent search and from observations of available commercial devices it is obvious that the most serious deficiencies of the prior art for cleanup of dog litter are: (1) they are cumbersome and inconvenient to carry around, (2) they become soiled with dog feces upon use and must be cleaned, and (3) they appear as obvious dog litter cleanup tools and are thus aesthetically unpleasing. The design of my bag eliminates all three of these deficiencies.

My invention is essentially a bag with two stiffener ribs at or near the bag opening. The length of each stiffener is roughly one-third of the circumference of the bag opening and each rib is flexibly attached to one end of the other. Though one-third the circumference is the optimum stiffener length, they can range from about 30% to about 40% of the circumference. Alternatively, the total length of the two stiffeners can be between about 60% and 80% of the circumference, and the individual stiffeners can have different lengths but should total 60% to 80%.

The bags of my invention are disposable and are preferably a plastic such as polyethylene or other polyolefin, but may be paper, other fabric or non-woven material, provided the cost is relatively low. The bags may be any size ranging from about one cup to about one gallon or even larger. The opening can range from about 10 inches (25 centimeters) to about 20 inches (50 centimeters) or even more in circumference.

The stiffeners, which are the key part of my invention, may be any fairly rigid low-cost material which can be easily formed on the bag during manufacture or can be attached to the bag by adhesives or fasteners. These stiffeners may be of wood, stiff cardboard, fiber glass, wire, or plastic. Ideally, the ribs are molded onto the bag during manufacture. The width and thickness (or the diameter, if cylindrical) of the stiffener should be the minimum to achieve just enough stiffness and strength to support the bag opening when the litter is pushed into it. A bag without stiffeners cannot be held open for filling without the use of a special device. I generally prefer that the unstiffened portion of the bag opening be left in its original limp condition so that it can be drawn taut in use.

To use the bags of my invention one needs only to spread the two stiffener ribs apart until the unstiffened portion of the bag opening becomes taut. This unstiffened taut rim of the bag is placed on the ground adjacent to the litter and held open by pressing lightly with a finger on the flexibly joined stiffener ends. While the bag is held open and pressed to the ground in this manner the litter is pushed into it with a tissue, leaves, twigs, paper, or a disposable splint of wood. The bag and contents are then disposed of in the nearest trash barrel.

My invention, though very simple in concept and simple to use has, no doubt by virtue of its simplicity, been overlooked as a solution to the pet litter cleanup problem. In this regard, it is in the same category as the invention of the eraser on a pencil or of the paper clip—inventions which are simple, which make a real contribution to consumer products, and which are unobvious until invented.

For a better understanding of the invention, reference is made to the accompanying drawings and the following descriptive matter in which there is illustrated the essential features.

DESCRIPTION OF THE DRAWINGS

The accompanying two figures, along with the following explanation, will give a clearer picture of my invention.

FIG. A is a side elevational view of a bag (1) in the unopened position; and

FIG. B is a perspective view of the same showing the bag in the open position ready for use.

FIG. A shows a bag (1) with stiffeners (2) along the opening edge. The unstiffened portion of the bag opening (3) remains limp and flexible.

To use the bag, the stiffeners (2) are spread apart manually as shown in FIG. B until the unstiffened edge (3) of the bag opening becomes taut. The stiffeners remain held together at the other end by a flexible connection which may be the bag itself. In this open position the taut edge (3) of the bag (1) is placed upon the ground (6) adjacent to the litter (7) and is held in this position by a finger (5) pressing upon the joined ends of the stiffeners. The litter is then pushed into the bag opening (4). If desired, the bag may be tied shut before disposal with a rubber band or with a twist tie of the type supplied with plastic bags.

EXAMPLES OF THE INVENTION

EXAMPLE 1

A one quart Hefty Baggie, made of polyethylene by Mobil Chemical Co. of Pittsford, N.Y. was used. The bag opening is 34 centimeters (13½ inches) in circumference, and 23 centimeters (9 inches) deep. Two polystyrene plastic splints 1 millimeter thick and 5 millimeters wide by 11 centimeters in length were adhered to the rim of the bag with one end of each in contact with one end of the other. The stiffeners were adhered to the bag rim with double faced pressure-sensitive adhesive tape made by 3M Company, St. Paul, Minn. To use the bag it was opened by spreading the splints apart until the unstiffened edge became taut. This taut edge was then placed on the ground, a finger was pressed on the other, flexibly connected, ends of the splints to hold the bag open and in place, and the dog litter was pushed into the bag with a nearby twig. The twig was placed in the bag, the bag was tied shut, and the bag and contents were disposed of in the nearest trash barrel.

EXAMPLE 2

A one gallon Hefty Baggie made of polyethylene by Mobil Chemical Co. was used. The bag opening is 58 centimeters (23 inches) in circumference and 32 centimeters (12½ inches) in depth. Two wood splints about 1 millimeter thick and 7 millimeters wide by 19 centimeters (7½ inches) in length were adhered to the rim of the bag using Super Jet cyanoacrylate adhesive sold by Carl Goldberg Models, Inc., of Chicago, Ill. One end of each stiffener was in close proximity with one end of the other stiffener. In use, the opposite ends of the stiffeners were spread apart until the unstiffened edge became taut. This taut edge was placed on the ground adjacent to the litter and held in place by pressing on the joined ends of the stiffeners. A tissue was used to push the litter into the bag, then the tissue and bag with contents was disposed of in the nearest trash receptacle. Adhesion of the stiffeners to the bag was not strong but was adequate for this use.

EXAMPLE 3

A two quart paper bag was used. The manufacturer is unknown. The circumference of the opening is 43 centimeters (17 inches). Two strong cardboard strips 3 millimeters by 10 millimeters by 15 centimeters (6 inches) were adhered along the opening with one end of each flexibly joined to the other. The adhesive used was 3M Fastbond 10 contact cement made by the 3M Company, St. Paul, Minn. The bag was used in the manner described in examples 1 and 2, but a wood tongue depressor was used to push the litter into the bag.

EXAMPLE 4

A one quart Hefty Baggie as described in example 1 was used. The surface of the polyethylene near the rim of the bag was treated by flaming with an alcohol burner flame while the bag was held in contact with a cold steel surface. Two polystyrene splints as in example 1 were adhered to this treated surface using 3M CA40H Pronto adhesive. The bag was used in the same manner as those in previous examples.

I have above described the embodiments of my invention, facilitating the use of bags for the pickup of litter from dogs and other pets, and I believe that my invention provides an easier to use, cleaner, and more discreet method of litter pickup than those methods or devices now available.

What is claimed is:

1. A litter pickup bag having two nonfolding stiffener ribs permanently attached at or near the bag opening, said ribs being flexibly joined to each other at one end defining a hinge point, the total combined length of said ribs being not less than approximately 60% or more than approximately 80% of the bag opening perimeter in length, the ribs and bags being disposable after use, the portion of the bag opening perimeter in excess of 60% or 80% being free of said stiffener ribs, and means for maintaining the bag opening in an open position by manually pressing said hinge point to maintain the bag opening open and upright and forcing the portion at the bag opening free of said stiffening ribs sufficiently taut.

2. A bag according to claim 1 in which the stiffener ribs are comprised of plastic.

3. A bag according to claim 1 in which the stiffener ribs are comprised of wood.

4. A bag according to claim 1 in which the stiffener ribs are attached to the bag by means of an adhesive.

5. A bag according to claim 1 in which the bag is comprised of a plastic of the polyolefin variety.

6. A bag according to claim 1 in which the stiffening ribs are molded onto and thereby become part of the bag during manufacture.

7. A bag according to claim 1 in which the bag is comprised of paper.

8. A bag according to claim 7 in which the stiffening ribs are comprised of paperboard.

9. A method for collecting litter comprising placing a bag of claim 1 near the litter, with the distal ends of the stiffener ribs spread apart so as to make taut the unstiffened portion of the bag opening circumference, and sweeping the litter into the bag over said taut portion.

* * * * *